US008590630B2

(12) United States Patent
Mathiesen et al.

(10) Patent No.: US 8,590,630 B2
(45) Date of Patent: Nov. 26, 2013

(54) SYSTEM AND METHOD FOR CONTROLLING THE FLOW OF FLUID IN BRANCHED WELLS

(75) Inventors: Vidar Mathiesen, Porsgrunn (NO); Haavard Aakre, Skien (NO)

(73) Assignee: Statoil ASA, Stavanger (NO)

( * ) Notice: Subject to any disclaimer, the term of this patent is extended or adjusted under 35 U.S.C. 154(b) by 393 days.

(21) Appl. No.: 12/921,806

(22) PCT Filed: Mar. 10, 2009

(86) PCT No.: PCT/NO2009/000088

§ 371 (c)(1),
(2), (4) Date: Nov. 17, 2010

(87) PCT Pub. No.: WO2009/113870

PCT Pub. Date: Sep. 17, 2009

(65) Prior Publication Data

US 2011/0048732 A1 Mar. 3, 2011

(30) Foreign Application Priority Data

Mar. 12, 2008 (NO) ..... 20081317

(51) Int. Cl.
*E21B 43/14* (2006.01)
*E21B 34/08* (2006.01)

(52) U.S. Cl.
USPC ..... 166/386; 166/50; 166/169; 166/313

(58) Field of Classification Search
USPC ..... 166/386, 373, 370, 50, 313, 169; 137/533.19, 533.17, 533
See application file for complete search history.

(56) References Cited

U.S. PATENT DOCUMENTS 3,550,616 A * 12/1970 Graham et al. ..... 137/513.7
4,577,691 A 3/1986 Huang et al.

(Continued)

FOREIGN PATENT DOCUMENTS

EP 327432 A2 8/1989
EP 327432 B1 8/1989

(Continued)

OTHER PUBLICATIONS

"Coning", http://www.glossary.oilfield.slb.com/en/Terms/c/coning.aspx, downloaded Jun. 10, 2013.*

(Continued)

*Primary Examiner* — Jennifer H Gay
(74) *Attorney, Agent, or Firm* — Birch, Stewart, Kolasch & Birch, LLP

(57) ABSTRACT

A system and a method for controlling the flow of fluid in a branched well from a reservoir (29), the system including a completed main well (27) having at least one uncompleted branch well (25), an annulus (24) defined between the reservoir (29) and a production pipe (1) of the completed main well (27) and at least two successive swell packers or constrictors (26) defining at least one longitudinal section of the main well (27) and within which at least one branch well (25) is arranged, and including at least one autonomous valve (2) arranged in the longitudinal section of the main well (27) defined between the two successive swell packers or constrictors (26). The uncompleted branch wells (25) are provided to increase the drainage area, i.e., maximum reservoir contact (MRC).

20 Claims, 6 Drawing Sheets

(56) References Cited

U.S. PATENT DOCUMENTS

| | | | | |
|---|---|---|---|---|
| 4,821,801 | A | 4/1989 | Van Laar | |
| 4,858,691 | A | 8/1989 | Ilfrey et al. | |
| 5,337,808 | A | 8/1994 | Graham | |
| 5,732,776 | A | 3/1998 | Tubel et al. | |
| 6,112,817 | A | 9/2000 | Voll et al. | |
| 6,279,660 | B1 | 8/2001 | Hay | |
| 6,951,252 | B2 * | 10/2005 | Restarick et al. | 166/313 |
| 7,063,162 | B2 | 6/2006 | Daling et al. | |
| 7,819,196 | B2 * | 10/2010 | Aakre | 166/369 |
| 2001/0013412 | A1 | 8/2001 | Tubel | |
| 2003/0024700 | A1 | 2/2003 | Cavender | |
| 2003/0221834 | A1 | 12/2003 | Hess et al. | |
| 2004/0055752 | A1 * | 3/2004 | Restarick et al. | 166/313 |
| 2006/0027377 | A1 * | 2/2006 | Schoonderbeek et al. | 166/386 |
| 2006/0175065 | A1 * | 8/2006 | Ross | 166/386 |
| 2007/0193752 | A1 | 8/2007 | Kim | |
| 2008/0035875 | A1 * | 2/2008 | Tai et al. | 251/318 |
| 2009/0218103 | A1 * | 9/2009 | Aakre et al. | 166/373 |
| 2011/0048732 | A1 * | 3/2011 | Mathiesen et al. | 166/373 |
| 2011/0056700 | A1 * | 3/2011 | Mathiesen et al. | 166/369 |

FOREIGN PATENT DOCUMENTS

| | | | |
|---|---|---|---|
| GB | 2169018 | A | 7/1986 |
| WO | WO 92/08875 | A2 | 5/1992 |
| WO | WO 2008/004875 | A1 | 1/2008 |

OTHER PUBLICATIONS

Abstract for NO-307,192-B1, Feb. 21, 2000, 1 page.

White, "Controlling Flow in Horizontal Wells", World Oil, Nov. 1991, pp. 73-80, with one sheet attachment.

* cited by examiner

SYSTEM AND METHOD FOR CONTROLLING THE FLOW OF FLUID IN BRANCHED WELLS

The present invention relates to a system and method for controlling the flow of a fluid in branched wells. More specifically the invention relates to a system and a method as disclosed in the preamble of claims 1 and 6, respectively.

In a preferred embodiment of the invention a plurality of autonomous valves or flow control devices are substantially as those described in WO 2008/004875 A1, belonging to the applicant of the present application.

Devices for recovering of oil and gas from long, horizontal and vertical wells are known from U.S. Pat. Nos. 4,821,801, 4,858,691, 4,577,691 and GB patent publication No. 2169018. These known devices comprise a perforated drainage pipe with, for example, a filter for control of sand around the pipe. A considerable disadvantage with the known devices for oil/and or gas production in highly permeable geological formations is that the pressure in the drainage pipe increases exponentially in the upstream direction as a result of the flow friction in the pipe. Because the differential pressure between the reservoir and the drainage pipe will decrease upstream as a result, the quantity of oil and/or gas flowing from the reservoir into the drainage pipe will decrease correspondingly. The total oil and/or gas produced by this means will therefore be low. With thin oil zones and highly permeable geological formations, there is further a high risk that of coning, i.e. flow of unwanted water or gas into the drainage pipe downstream, where the velocity of the oil flow from the reservoir to the pipe is the greatest.

From World Oil, vol. 212, N. 11 (11/91), pages 73-80, is previously known to divide a drainage pipe into sections with one or more inflow restriction devices such as sliding sleeves or throttling devices. However, this reference is mainly dealing with the use of inflow control to limit the inflow rate for up hole zones and thereby avoid or reduce coning of water and or gas.

WO-A-9208875 describes a horizontal production pipe comprising a plurality of production sections connected by mixing chambers having a larger internal diameter than the production sections. The production sections comprise an external slotted liner which can be considered as performing a filtering action. However, the sequence of sections of different diameter creates flow turbulence and prevent the running of work-over tools.

When extracting oil and or gas from geological production formations, fluids of different qualities, i.e. oil, gas, water (and sand) is produced in different amounts and mixtures depending on the property or quality of the formation. None of the above-mentioned, known devices are able to distinguish between and control the inflow of oil, gas or water on the basis of their relative composition and/or quality.

With the autonomous valve as described in WO 2008/004875 A1 is provided an inflow control device which is self adjusting or autonomous and can easily be fitted in the wall of a production pipe and which therefore provide for the use of work-over tools. The device is designed to "distinguish" between the oil and/or gas and/or water and is able to control the flow or inflow of oil or gas, depending on which of these fluids such flow control is required.

The device as disclosed in WO 2008/004875 A1 is robust, can withstand large forces and high temperatures, needs no energy supply, can withstand sand production, is reliable, but is still simple and very cheap.

A problem with the prior art is that one well will cover a limited reservoir area, and hence that the drainage and oil production from one single well is limited.

The system and method according to the invention seeks to reduce or eliminate the above and other problems or disadvantages by providing a substantially constant volume rate and a phase-filter along wells, even for a multilayered reservoir.

The system and method according to the invention are characterized by the features as disclosed in the characterizing clause of claims 1 and 6, respectively.

Advantageous embodiments are set forth in the dependent claims.

The present invention will be further described in the following by means of examples and with reference to the drawings, where:

Figure 9:
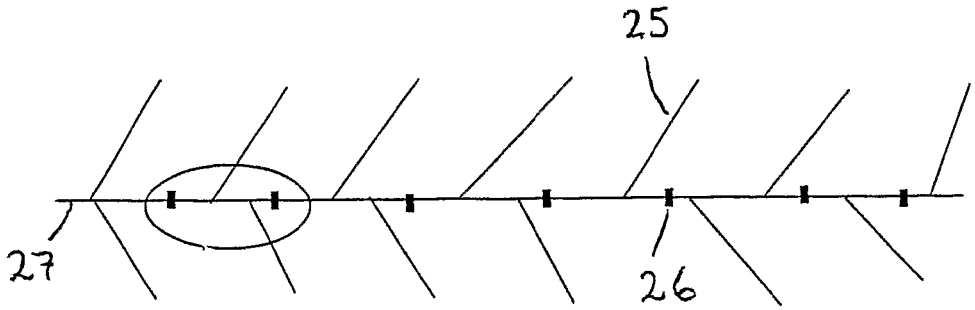
FIG. 9 shows an elevation view of part of a completed main well with uncompleted branches.
Figure 9A:
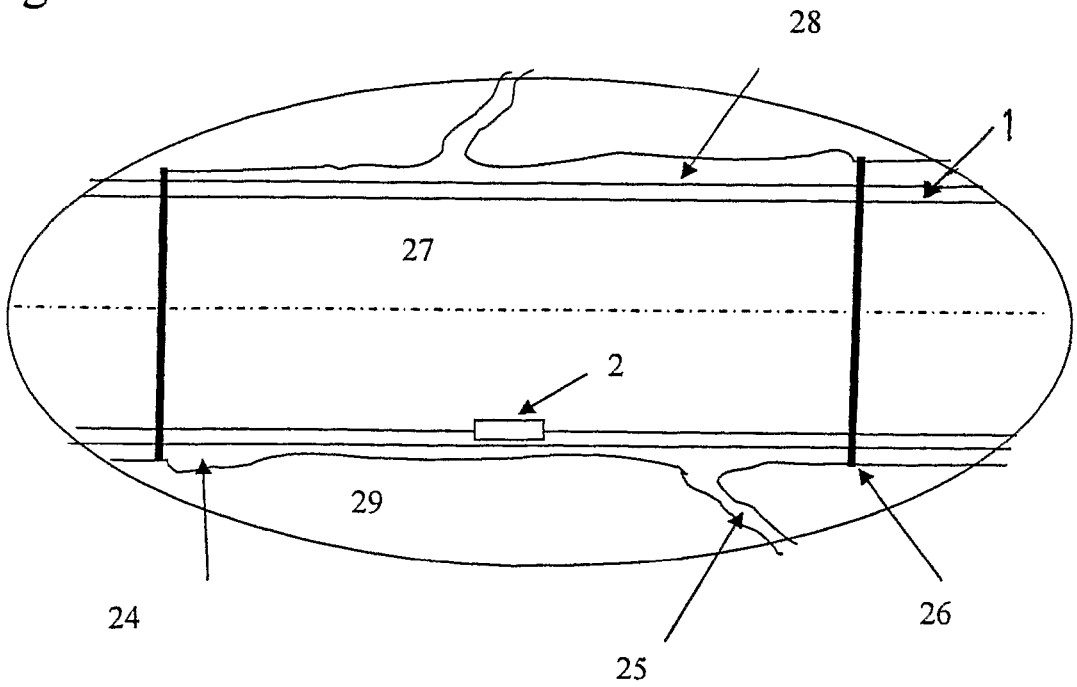

FIG. 9*a* substantially shows an enlarged view of the part of FIG. 9 constricted by an oval.

Figure 1:
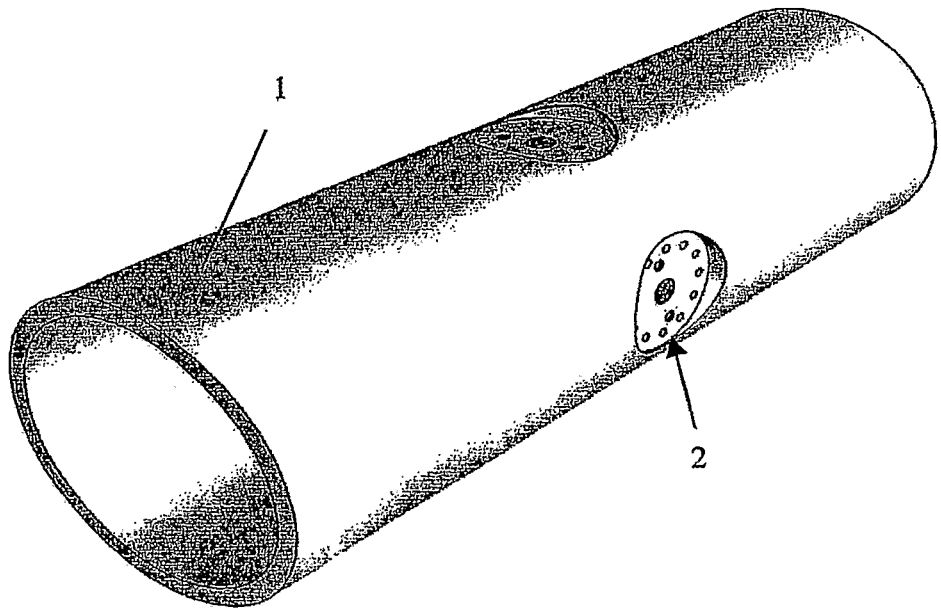
FIG. 1 shows a schematic view of a production pipe with a control device according to WO 2008/004875 A1, FIG. 2 a) shows, in larger scale, a cross section of the control device according to WO 2008/004875 A1, b) shows the same device in a top view.

FIG. 1 shows, as stated above, a section of a production pipe 1 in which a control device 2, according to WO 2008/004875 A1 is provided. The control device 2 is preferably of circular, relatively flat shape and may be provided with external threads 3 (see FIG. 2) to be screwed into a circular hole with corresponding internal threads in the pipe or an injector. By controlling the thickness, the device 2, may be adapted to the thickness of the pipe or injector and fit within its outer and inner periphery.

Figure 2:
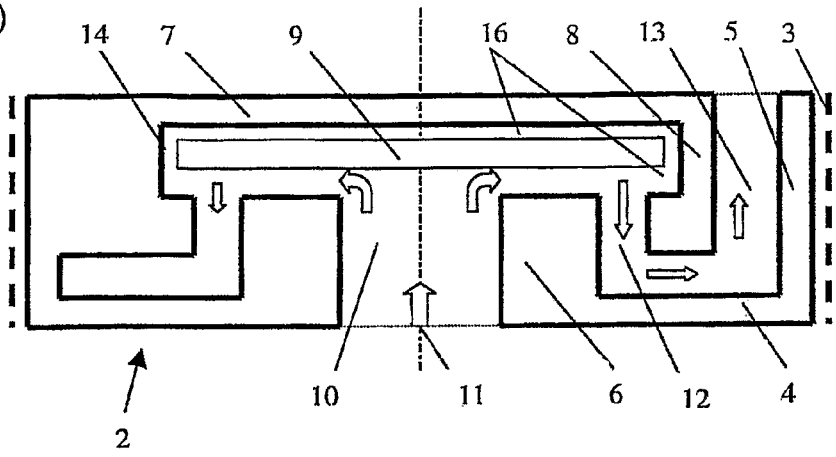
Figure 2:
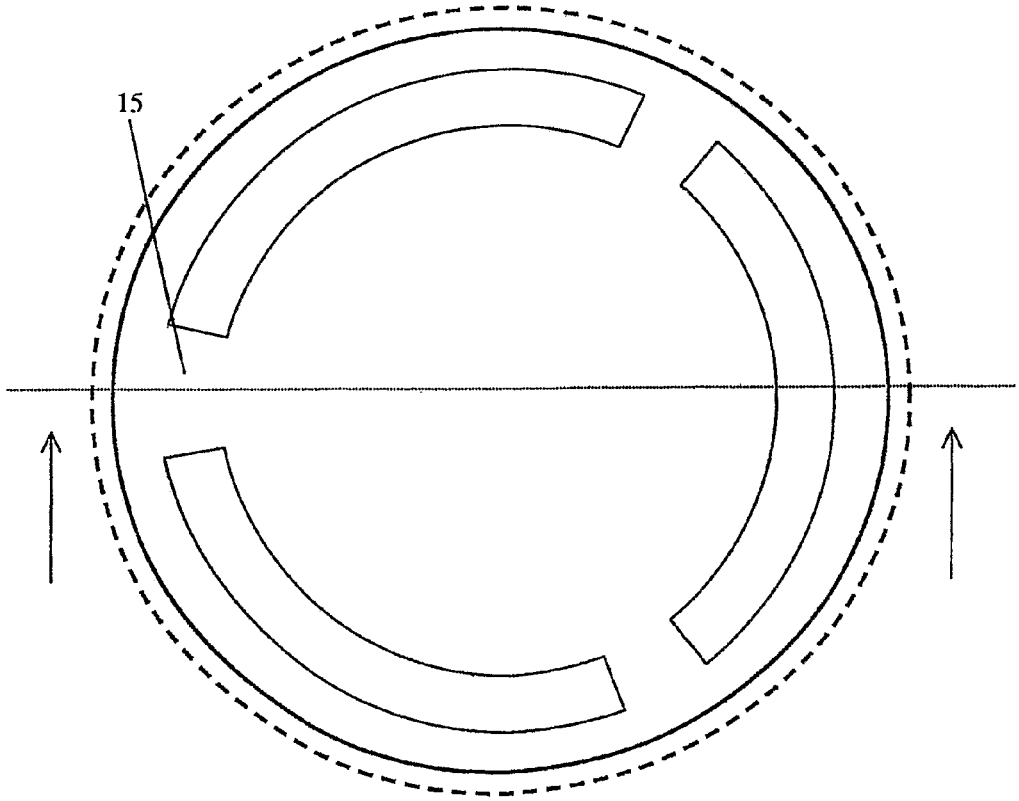

FIGS. 2 a) and b) shows the prior control device 2 of WO 2008/004875 A1 in larger scale. The device consists of a first disc-shaped housing body 4 with an outer cylindrical segment 5 and inner cylindrical segment 6 and with a central hole or aperture 10, and a second disc-shaped holder body 7 with an outer cylindrical segment 8, as well as a preferably flat disc or freely movable body 9 provided in an open space 14 formed between the first 4 and second 7 disc-shaped housing and holder bodies. The body 9 may for particular applications and adjustments depart from the flat shape and have a partly conical or semicircular shape (for instance towards the aperture 10.) As can be seen from the figure, the cylindrical segment 8 of the second disc-shaped holder body 7 fits within and protrudes in the opposite direction of the outer cylindrical segment 5 of the first disc-shaped housing body 4 thereby forming a flow path as shown by the arrows 11, where the fluid enters the control device through the central hole or aperture (inlet) 10 and flows towards and radially along the disc 9 before flowing through the annular opening 12 formed between the cylindrical segments 8 and 6 and further out through the annular opening 13 formed between the cylindrical segments 8 and 5. The two disc-shaped housing and holder bodies 4, 7 are attached to one another by a screw connection, welding or other means (not further shown in the figures) at a connection area 15 as shown in FIG. 2*b*).

The present invention exploits the effect of Bernoulli teaching that the sum of static pressure, dynamic pressure and friction is constant along a flow line:

$$P_{static} + \frac{1}{2}\rho v^2 + \Delta p_{friction}$$

When subjecting the disc 9 to a fluid flow, which is the case with the present invention, the pressure difference over the disc 9 can be expressed as follows:

$$\Delta p_{over} = [p_{over(P_4)} - p_{under(f(p_1,p_2,p_3))}] = \frac{1}{2}\rho v^2$$

Due to lower viscosity, a fluid such as gas will "make the turn later" and follow further along the disc towards its outer end (indicated by reference number 14). This makes a higher stagnation pressure in the area 16 at the end of the disc 9, which in turn makes a higher pressure over the disc. And the disc 9, which is freely movable within the space between the disc-shaped bodies 4, 7, will move downwards and thereby narrow the flow path between the disc 9 and inner cylindrical segment 6. Thus, the disc 9 moves dawn-wards or up-wards depending on the viscosity of the fluid flowing through, whereby this principle can be used to control (close/open) the flow of fluid through of the device.

Figure 3:
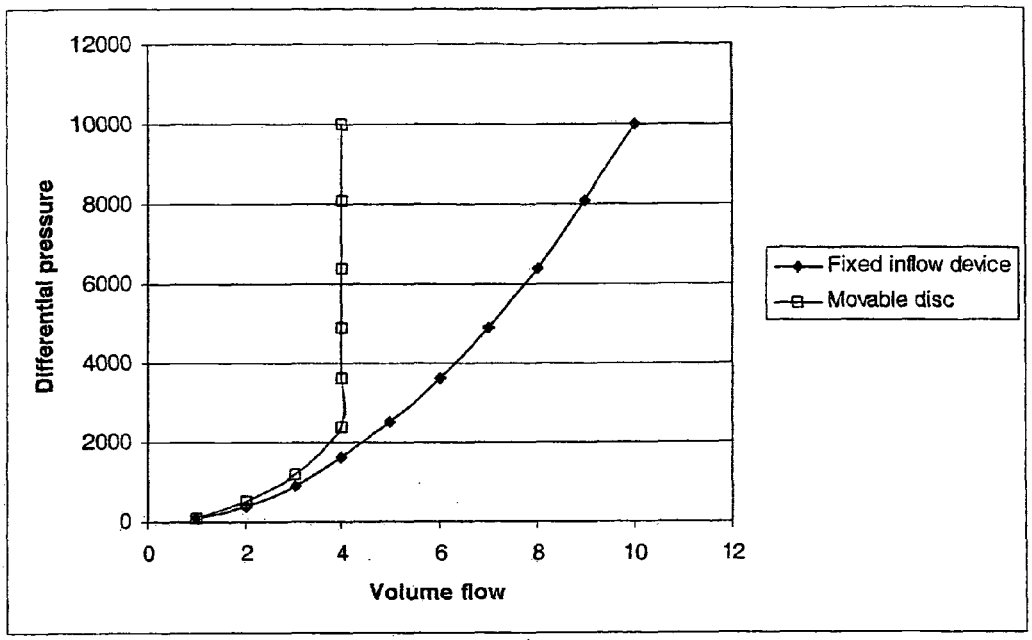
FIG. 3 is a diagram showing the flow volume through a control device according to the invention vs. the differential pressure in comparison with a fixed inflow device.

Further, the pressure drop through a traditional inflow control device (ICD) with fixed geometry will be proportional to the dynamic pressure:

$$\Delta p = K \cdot \frac{1}{2}\rho v^2$$

where the constant, K is mainly a function of the geometry and less dependent on the Reynolds number. In the control device according to the present invention the flow area will decrease when the differential pressure increases, such that the volume flow through the control device will not, or nearly not, increase when the pressure drop increases. A comparison between a control device according to the present invention with movable disc and a control device with fixed flow-through opening is shown in FIG. 3, and as can be seen from the figure, the flow-through volume for the present invention is constant above a given differential pressure.

This represents a major advantage with the present invention as it can be used to ensure the same volume flowing through each section for the entire horizontal well, which is not possible with fixed inflow control devices.

Figure 4:
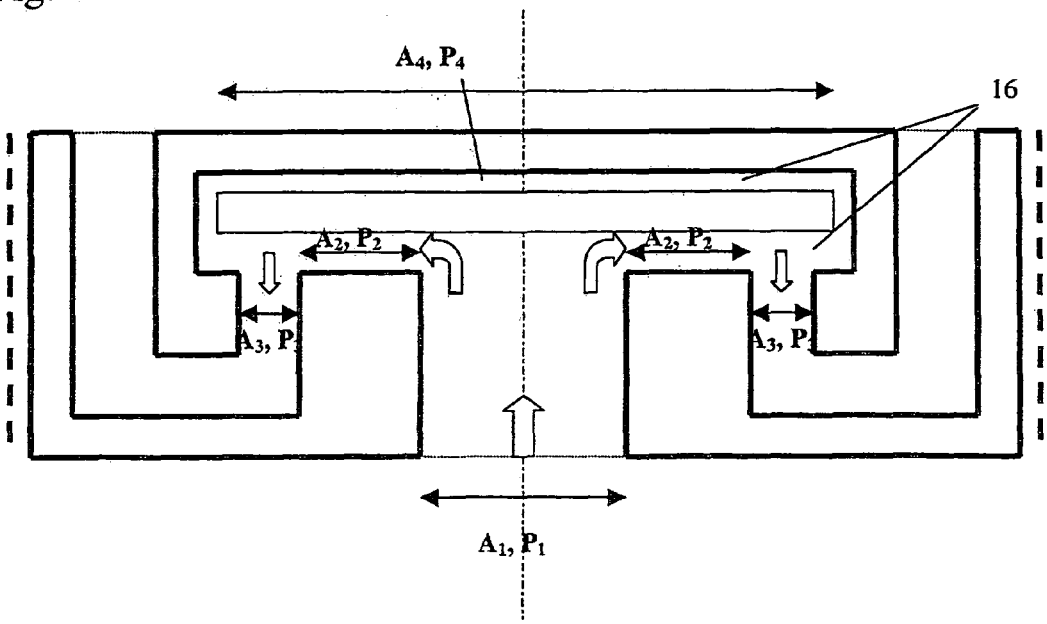
FIG. 4 shows the device shown in FIG. 2, but with the indication of different pressure zones influencing the design of the device for different applications.

When producing oil and gas the control device according to the invention may have two different applications: Using it as inflow control device to reduce inflow of water, or using it to reduce inflow of gas at gas break through situations. When designing the control device according to the invention for the different application such as water or gas, as mentioned above, the different areas and pressure zones, as shown in FIG. 4, will have impact on the efficiency and flow through properties of the device. Referring to FIG. 4, the different area/pressure zones may be divided into:

- $A_1$, $P_1$ is the inflow area and pressure respectively. The force ($P_1 \cdot A_1$) generated by this pressure will strive to open the control device (move the disc or body 9 upwards).
- $A_2$, $P_2$ is the area and pressure in the zone where the velocity will be largest and hence represents a dynamic pressure source. The resulting force of the dynamic pressure will strive to close the control device (move the disc or body 9 downwards as the flow velocity increases).
- $A_3$, $P_3$ is the area and pressure at the outlet. This should be the same as the well pressure (inlet pressure).
- $A_4$, $P_4$ is the area and pressure (stagnation pressure) behind the movable disc or body 9. The stagnation pressure, at position 16 (FIG. 2), creates the pressure and the force behind the body. This will strive to close the control device (move the body downwards).

Fluids with different viscosities will provide different forces in each zone depending on the design of these zones. In order to optimize the efficiency and flow through properties of the control device, the design of the areas will be different for different applications, e.g. gas/oil or oil/water flow. Hence, for each application the areas needs to be carefully balanced and optimally designed taking into account the properties and physical conditions (viscosity, temperature, pressure etc.) for each design situation.

Figure 5:
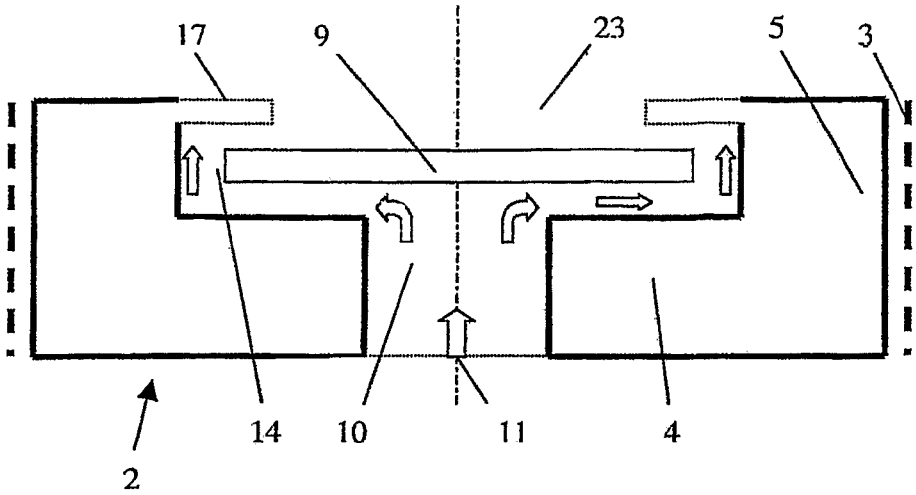
FIG. 5 shows a principal sketch of another embodiment of the control device according to WO 2008/004875 A1.

FIG. 5 shows a principal sketch of another embodiment of the control device according to WO 2008/004875 A1, which is of a more simple design than the version shown in FIG. 2. The control device 2 consists, as with the version shown in FIG. 2, of a first disc shaped housing body 4 with an outer cylindrical segment 5 and with a central hole or aperture 10, and a second disc-shaped holder body 17 attached to the segment 5 of the housing body 4, as well as a preferably flat disc 9 provided in an open space 14 formed between the first and second disc-shaped housing and holder bodies 4, 17. However, since the second disc-shaped holder body 17 is inwardly open (through a hole or holes 23, etc.) and is now only holding the disc in place, and since the cylindrical segment 5 is shorter with a different flow path than what is shown in FIG. 2, there is no build up of stagnation pressure ($P_4$) on the back side of the disc 9 as explained above in conjunction with FIG. 4. With this solution without stagnation pressure the building thickness for the device is lower and may withstand a larger amount of particles contained in the fluid.

Figure 6:
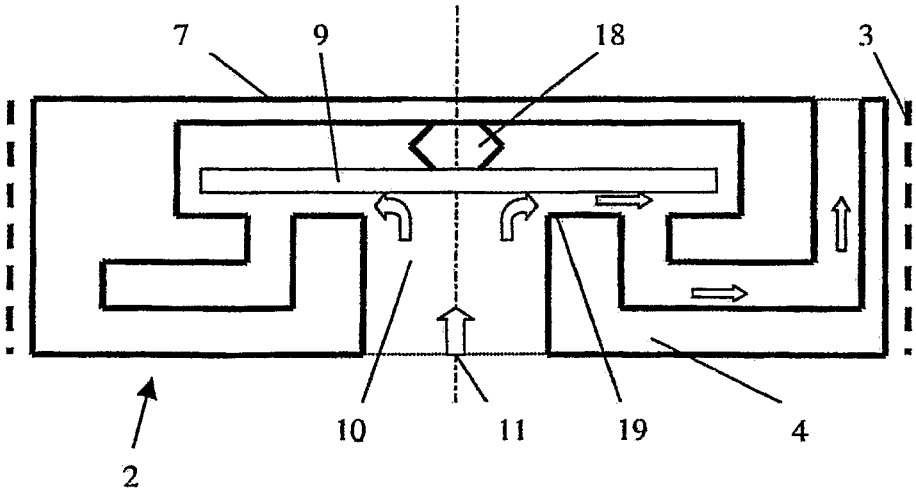
FIG. 6 shows a principal sketch of a third embodiment of the control device according to WO 2008/004875 A1.

FIG. 6 shows a third embodiment according to WO 2008/004875 A1 where the design is the same as with the example shown in FIG. 2, but where a spring element 18, in the form of a spiral or other suitable spring device, is provided on either side of the disc and connects the disc with the holder 7, 22, recess 21 or housing 4.

The spring element 18 is used to balance and control the inflow area between the disc 9 and the inlet 10, or rather the surrounding edge or seat 19 of the inlet 10. Thus, depending on the spring constant and thereby the spring force, the opening between the disc 9 and edge 19 will be larger or smaller, and with a suitable selected spring constant, depending on the inflow and pressure conditions at the selected place where the control device is provided, constant mass flow through the device may be obtained.

Figure 7:
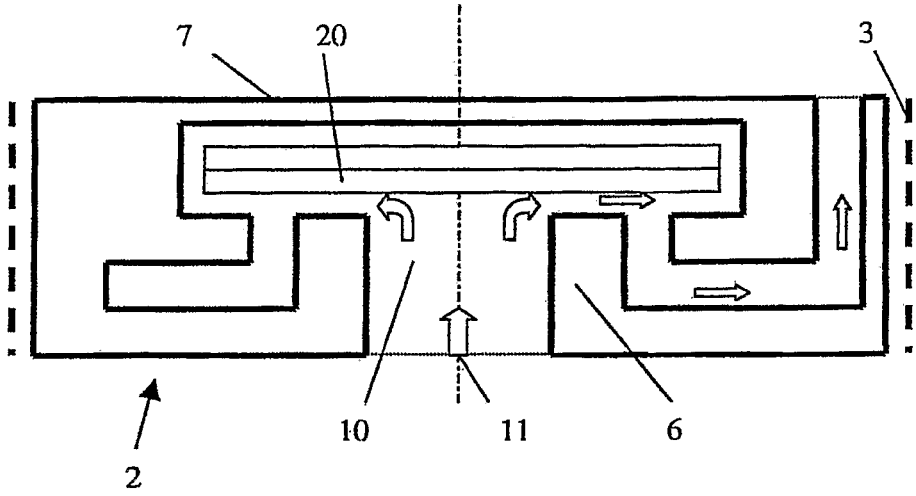
FIG. 7 shows a principal sketch of a fourth embodiment of the control device according to WO 2008/004875 A1.

FIG. 7 shows a fourth embodiment according to WO 2008/004875 A1, where the design is the same as with the example in FIG. 6 above, but where the disc 9 is, on the side facing the inlet opening 10, provided with a thermally responsive device such as bi-metallic element 20.

When producing oil and/or gas the conditions may rapidly change from a situation where only or mostly oil is produced to a situation where only or mostly gas is produced (gas breakthrough or gas coning). With for instance a pressure drop of 16 bar from 100 bar the temperature drop would correspond to approximately 20° C. By providing the disc 9 with a thermally responsive element such as a bi-metallic element as shown in FIG. 7, the disc will bend upwards or be moved upwards by the element 20 abutting the holder shaped body 7 and thereby narrowing the opening between the disc and the inlet 10 or fully closing said inlet.

Figure 8:
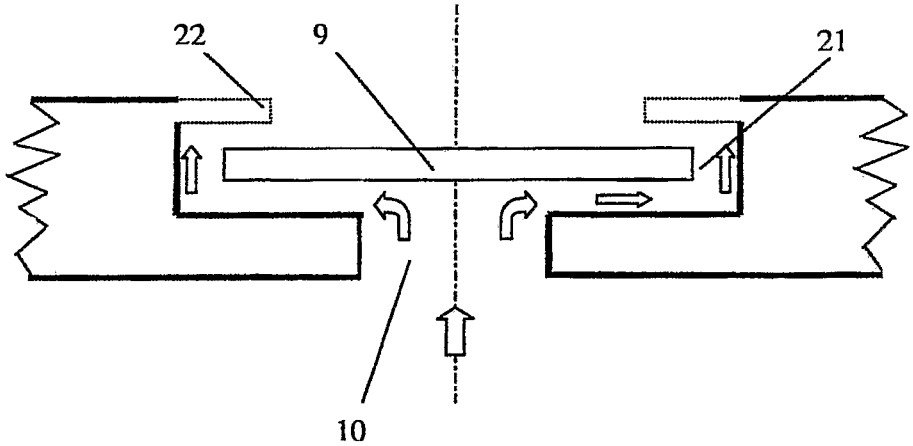
FIG. 8 shows a principal sketch of a fifth embodiment of WO 2008/004875 A1 where the control device is an integral part of a flow arrangement.

The above examples of a control device as shown in FIGS. 1 and 2 and 4-7 are all related to solutions where the control device as such is a separate unit or device to be provided in conjunction with a fluid flow situation or arrangement such as the wall of a production pipe in connection with the production of oil and gas. However, the control device may, as shown in FIG. 8, be an integral part of the fluid flow arrangement, whereby the movable body 9 may be provided in a recess 21 facing the outlet of an aperture or hole 10 of for instance a wall of a pipe 1 as shown in FIG. 1 instead of being provided in a separate housing body 4. Further, the movable body 9 may be held in place in the recess by means of a holder device such as inwardly protruding spikes, a circular ring 22 or the like being connected to the outer opening of the recess by means of screwing, welding or the like.

FIGS. 9 and 9*a* show a part of a completed main well 27 having uncompleted branch wells 25 and swell packers or constrictors 26. In FIG. 9*a* is also shown a reservoir 29, an annulus 24 defined between the reservoir 29 and the production pipe 1, a sand screen 28 arranged within the annulus 24, and an autonomous valve 2—preferably of the type as disclosed in WO 2008/004875 A1 and as described above—arranged in a longitudinal section of the main well 27 defined between two successive swell packers or constrictors 26.

In FIGS. 9 and 9*a* one autonomous valve 2 is preferably arranged within each section of the main well 27 defined between two successive swell packers or constrictors 26 and having at least one branch well 25. One or several sections might in addition, or instead, comprise natural fractions in the formation or fractures made by downhole use of explosives, said fractures resulting in a non-uniform drainage or pressure profile and an increased drainage.

The method according to the invention comprises the following steps (not necessarily in said order):

- Providing a production pipe 1 comprising a plurality of autonomous valves 2 arranged along the length of said production pipe 1,
- drilling a main well 27,
- drilling at least one branch well 25 laterally from said main well 27,
- passing said production pipe 1 into said main well 27 for completing the main well 27,
- providing a plurality of swell packers or constrictors 26 along the main well 27, the swell packers or constrictors defining sections of production pipe within at least some sections of which the at least one branch well 25 and at least one autonomous valve 2 are arranged, and
- controlling the flow of fluid from said uncompleted branches 25 into each said section of production pipe 1 with the at least one autonomous valve 2 provided in said section.

The uncompleted branch wells 25 are provided to increase the drainage area, i.e. maximum reservoir contact (MRC).

With the valve or control device described in WO 2008/004875 A1, due to the constant volume rate, a much better drainage of the reservoir is thus achieved. This result in significant larger production of that reservoir.

By further referring to FIGS. 9 and 9*a*, the main well 27 preferably is a horizontal well in which the branches 25 are provided in a substantially horizontal plane or level. However it should be emphasized that wells of any inclination, including vertical wells, are within the scope of the present invention as stated in the appended claims.

As also mentioned in the introductionary part of the description, the autonomous valves 2 preferably are those described in WO 2008/004875 A1 and above, but any type of autonomous valve (e.g. electronically operated) is conceivable within the context of the invention.

The invention claimed is:

1. A system for controlling the flow of fluid in a branched well from a reservoir, the system comprising:

- a completed main well having at least one uncompleted branch well;
- an annulus defined between the reservoir and a production pipe of the completed main well;
- at least two successive swell packers or constrictors defining at least one longitudinal section of the main well and within which the at least one branch well is arranged; and
- at least one autonomous valve arranged in said longitudinal section of the main well defined between said two successive swell packers or constrictors, the autonomous valve being arranged to operate according to the Bernoulli principle.

2. The system according to claim 1, wherein a sand screen is arranged within said annulus.

3. The system according to claim 2, wherein the autonomous valve has a substantially constant flow-through volume above a given differential pressure.

4. The system according to claim 2, wherein the main well is a horizontal well.

5. The system according to claim 2, wherein the main well is of any inclination from horizontal, including vertical.

6. The system according to claim 1, wherein the autonomous valve has a substantially constant flow-through volume above a given differential pressure.

7. The system according to claim 6, wherein the main well is a horizontal well.

8. The system according to claim 6, wherein the main well is of any inclination from horizontal, including vertical.

9. The system according to claim 1, wherein the main well is a horizontal well.

10. The system according to claim 1, wherein the main well is a well of any inclination from horizontal, including vertical.

11. A method for controlling the flow of fluid in a branched well from a reservoir comprising the following steps:

- providing a production pipe comprising a plurality of autonomous valves arranged along the length of said production pipe,
- drilling a main well, drilling at least one branch well laterally from said main well,
- passing said production pipe into said main well for completing the main well,
- providing a plurality of swell packers or constrictors along the main well, the swell packers or constrictors defining sections of the production pipe within at least some sections of which the at least one branch well and at least one autonomous valve of the plurality of autonomous valves are arranged, the autonomous valve being arranged to operate according to the Bernoulli principle, and controlling the flow of fluid from said uncompleted branches into each said section of the production pipe with the at least one autonomous valve provided in said section.

12. The method according to claim 11, further comprising the step of arranging a sand screen within an annulus defined between the reservoir and the production pipe in at least one section defined between the two swell packers or constrictors.

13. The method according to claim 12, wherein the autonomous valve has a substantially constant flow-through volume above a given differential pressure.

14. The method according to claim 12, further comprising the step of drilling the main well as a horizontal well.

15. The method according to claim 12, further comprising the step of drilling the main well with any inclination from horizontal, including vertical.

16. The method according to claim 11, wherein the autonomous valve has a substantially constant flow-through volume above a given differential pressure.

17. The method according to claim 16, further comprising the step of drilling the main well as a horizontal well.

18. The method according to claim 16, further comprising the step of drilling the main well with any inclination from horizontal, including vertical.

19. The method according to claim 11, further comprising the step of drilling the main well as a horizontal well.

20. The method according to claim 11, further comprising the step of drilling the main well with any inclination from horizontal, including vertical.

* * * * *

UNITED STATES PATENT AND TRADEMARK OFFICE

CERTIFICATE OF CORRECTION

PATENT NO. : 8,590,630 B2
APPLICATION NO. : 12/921806
DATED : November 26, 2013
INVENTOR(S) : Mathiesen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 458 days.

Signed and Sealed this
Twenty-second Day of September, 2015

Michelle K. Lee

Michelle K. Lee
*Director of the United States Patent and Trademark Office*